US009366199B2

(12) United States Patent
Farzaneh

(10) Patent No.: US 9,366,199 B2
(45) Date of Patent: Jun. 14, 2016

(54) SLIDING ENGINE WITH SHAFT ON ONE OR BOTH ENDS FOR DOUBLE OR SINGLE ENDED COMBUSTION

(71) Applicant: Ali Farzad Farzaneh, Tehran (IR)

(72) Inventor: Ali Farzad Farzaneh, Tehran (IR)

( * ) Notice: Subject to any disclaimer, the term of this patent is extended or adjusted under 35 U.S.C. 154(b) by 0 days.

(21) Appl. No.: 14/709,358

(22) Filed: May 11, 2015

(65) Prior Publication Data

US 2015/0322875 A1 Nov. 12, 2015

Related U.S. Application Data

(60) Provisional application No. 61/991,378, filed on May 9, 2014.

(51) Int. Cl.

| | |
|---|---|
| ***F02B 75/00*** | (2006.01) |
| ***F02D 41/30*** | (2006.01) |
| ***F02D 37/02*** | (2006.01) |
| ***F02B 75/04*** | (2006.01) |
| ***F01B 11/02*** | (2006.01) |
| ***F01B 11/00*** | (2006.01) |
| *F02D 41/00* | (2006.01) |

(52) U.S. Cl.

CPC ..... *F02D 41/3011* (2013.01); *F01B 11/00* (2013.01); *F01B 11/007* (2013.01); *F01B 11/02* (2013.01); *F02B 75/04* (2013.01); *F02D 37/02* (2013.01); *F02D 41/30* (2013.01); *F02D 41/0002* (2013.01); *F02D 2400/02* (2013.01); *F02D 2700/10* (2013.01)

(58) Field of Classification Search

CPC .. F02B 2075/025; F02B 75/002; F02B 75/04; F02B 75/041; F02M 15/04

USPC ..... 123/46 R, 61 R–63, 78 R

See application file for complete search history.

(56) References Cited

U.S. PATENT DOCUMENTS

| | | | | | |
|---|---|---|---|---|---|
| 179,782 | A * | 7/1876 | Gilles | F02B 71/00 | 123/332 |
| 319,970 | A * | 6/1885 | Gaston | B64D 17/36 | 123/24 R |
| 349,858 | A * | 9/1886 | Riker | F02B 1/00 | 123/1 R |
| 402,549 | A * | 4/1889 | Wilcox | F02B 75/002 | 123/146 |
| 640,672 | A * | 1/1900 | Lewis | F02B 75/002 | 123/162 |
| 692,218 | A * | 1/1902 | Swan | F02B 33/22 | 123/161 |
| 808,572 | A * | 12/1905 | Palmer | F02B 75/28 | 123/193.1 |
| 890,546 | A * | 6/1908 | Wittmann et al. | E02D 7/10 | 123/61 R |
| 909,187 | A * | 1/1909 | Illmer, Jr. et al. | 123/188.1 | |
| 949,139 | A * | 2/1910 | Aslakson | F04B 49/16 | 123/58.3 |
| 968,636 | A * | 8/1910 | Aslakson | F02F 1/108 | 123/41.74 |

(Continued)

*Primary Examiner* — Thomas Moulis

(74) *Attorney, Agent, or Firm* — Adli Law Group P.C.

(57) ABSTRACT

The present disclosure relates to an improved internal combustion engine including a cylindrical cylinder, on either side a cylinder head is emplaced and a reciprocating piston and oil reserve tank is also located in the piston for lubricating the cylinder and it has two series of fire, compression and oil rings, located on two sides of the piston in order to seal the cylinder housing. The improved engine provides more compaction, discharge and better breath in comparison with common engines; wherein air is compressed into the cylinder and smoke exits from the cylinder speedily. The improved engine has a significant impact on fuel saving. In addition, smoke and air filters are emplaced on the valves which will produce less emissions compared with the similar engines. In comparison with similar engines in double-ended combustion engines, the fuel consumed is cut by 50% or cut by 25%. in single combustion engines.

9 Claims, 20 Drawing Sheets

(56) References Cited

U.S. PATENT DOCUMENTS 1,005,680 A * 10/1911 Babin ..... B25C 1/08 123/46 SC
1,024,440 A * 4/1912 Crowdes ..... 123/50 R
1,044,725 A * 11/1912 Bain ..... F01B 17/02 123/61 R
1,048,918 A * 12/1912 Van Vleck ..... F02B 75/002 123/193.1
1,092,886 A * 4/1914 Youmans ..... B25C 1/08 123/146.5 R
1,274,811 A * 8/1918 Sullivan ..... 123/55.7
1,356,576 A * 10/1920 Wickersham ..... F02B 75/28 123/41.82 R
1,405,551 A * 2/1922 Nichols ..... F02C 5/08 123/46 A
1,471,847 A * 10/1923 Holliday ..... F02B 25/00 123/51 B
1,477,994 A * 12/1923 Buchi ..... F02B 25/00 123/51 BD
1,517,191 A * 11/1924 Burnand ..... F01B 9/04 123/197.1
1,567,172 A * 12/1925 Powell ..... F01B 9/047 123/197.1
1,693,506 A * 11/1928 Hemmingsen ..... F02B 25/00 123/61 R
1,746,306 A * 2/1930 Ferguson ..... F02B 75/002 123/61 R
1,777,827 A * 10/1930 Curtis ..... F02B 25/00 123/61 R
1,862,640 A * 6/1932 Trechsel ..... F02B 75/002 123/41.78
1,943,870 A * 1/1934 Klaiber ..... F02B 75/002 123/195 R
2,693,076 A * 11/1954 Francis ..... F02B 47/02 123/46 A
2,814,551 A * 11/1957 Broeze ..... B01J 3/08 123/46 A
3,329,133 A * 7/1967 Panhard ..... F01B 11/08 123/446
3,358,656 A * 12/1967 Panhard ..... F01B 11/08 123/179.31
3,365,879 A * 1/1968 Panhard ..... F01B 11/08 123/46 A
3,610,217 A * 10/1971 Braun ..... F02B 71/00 123/192.1
4,372,256 A * 2/1983 Firey ..... F02B 45/00 123/179.21
4,385,597 A * 5/1983 Stelzer ..... F02B 71/00 123/46 A
4,498,430 A * 2/1985 Giuliani ..... F01B 9/047 123/197.3
4,763,478 A * 8/1988 Liemert ..... H01H 39/00 123/46 A
4,803,960 A * 2/1989 Koppen ..... F02B 71/00 123/46 A
5,287,827 A * 2/1994 Almendinger ..... F02B 71/00 123/46 R
7,258,086 B2 * 8/2007 Fitzgerald ..... F01B 9/047 123/46 R
8,127,544 B2 * 3/2012 Schwiesow ..... F02B 25/08 123/46 E
2008/0036312 A1 * 2/2008 Max ..... F02B 1/12 123/46 R
2010/0162998 A1 * 7/2010 Graef ..... F01B 11/007 123/46 SC
2012/0304855 A1 * 12/2012 Funato ..... F15B 15/1452 92/172

* cited by examiner

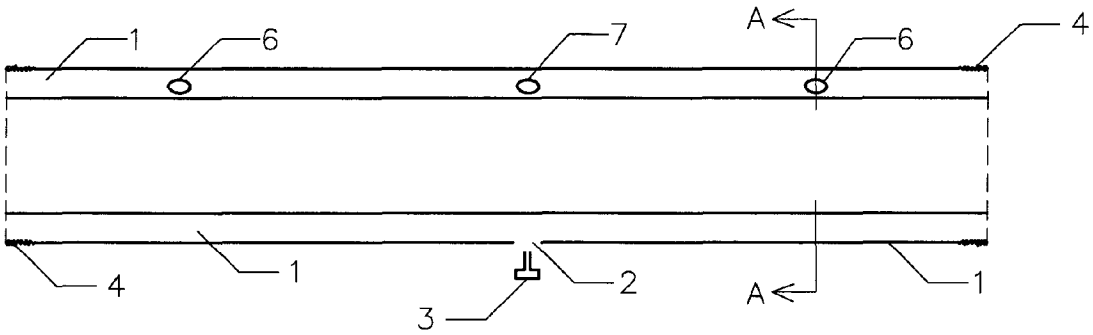
Fig 1A
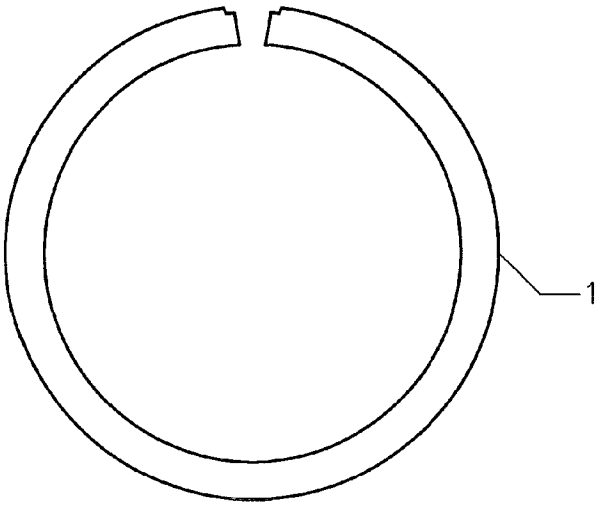
Fig 1B
Fig 1

First Door

Second Door

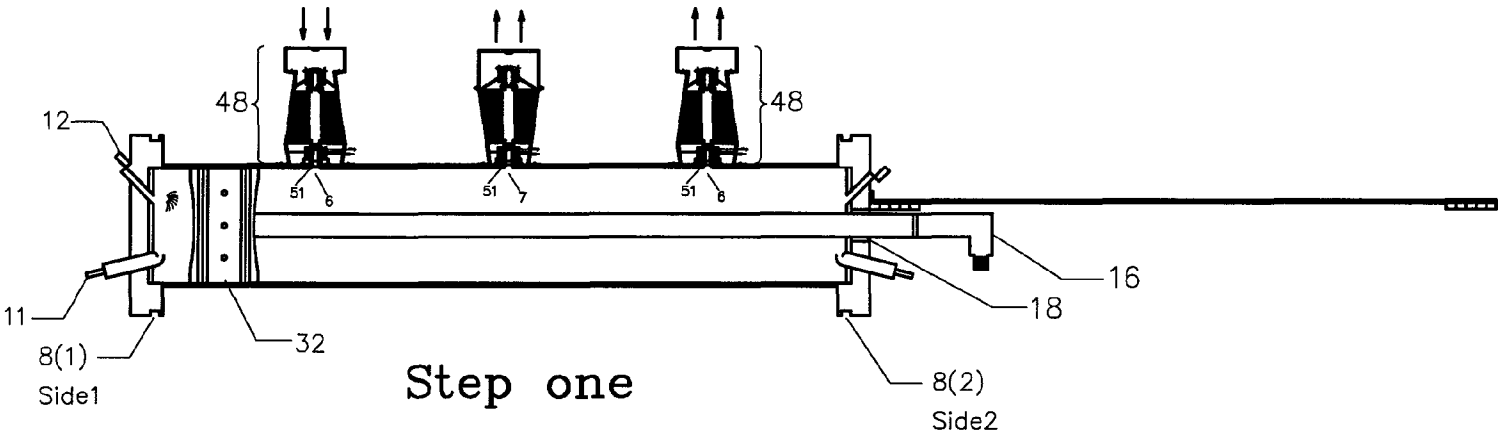
Step one
Fig 6A
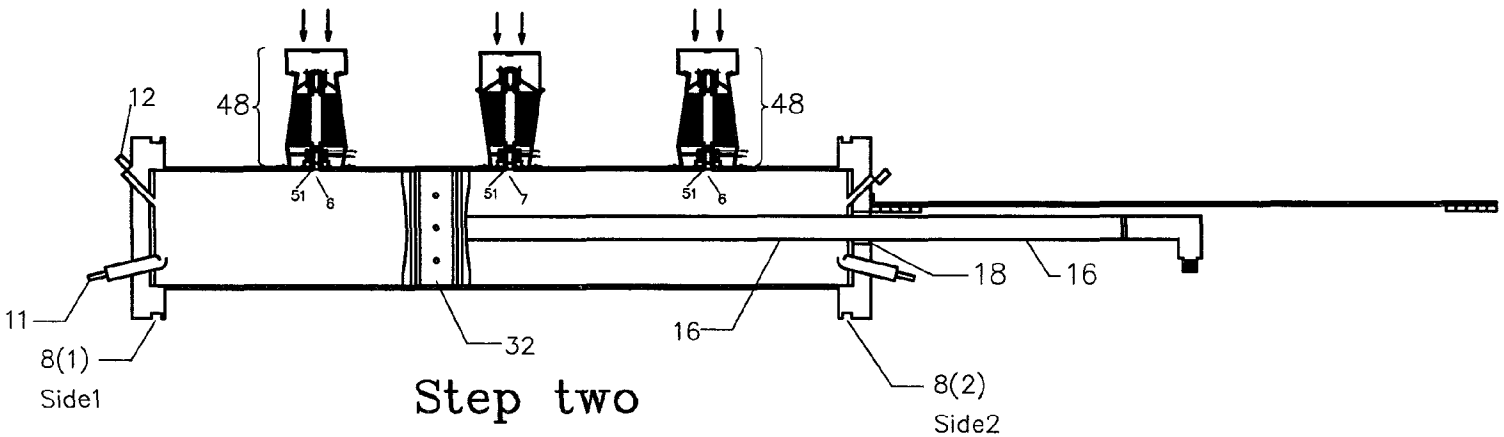
Step two
Fig 6B
Fig 6

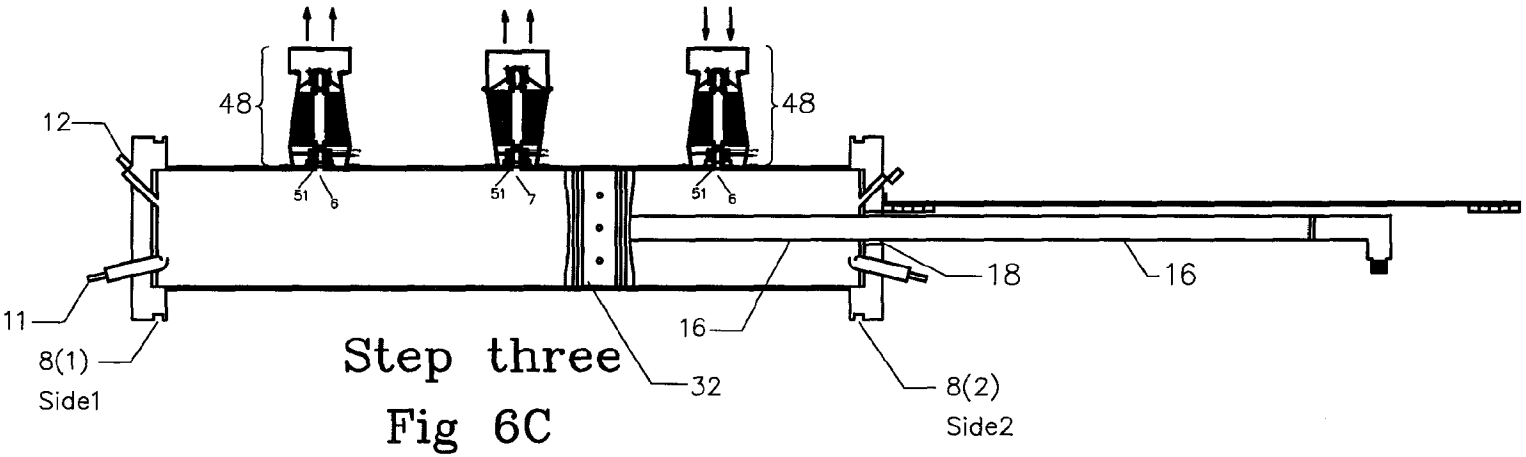
Step three
Fig 6C
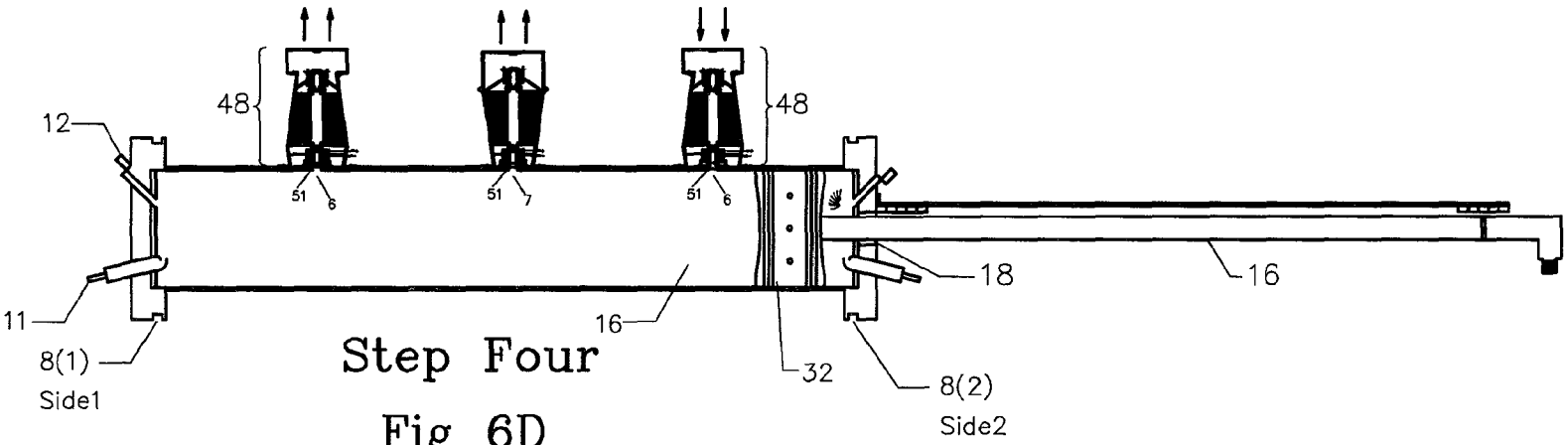
Step Four
Fig 6D
Fig 6

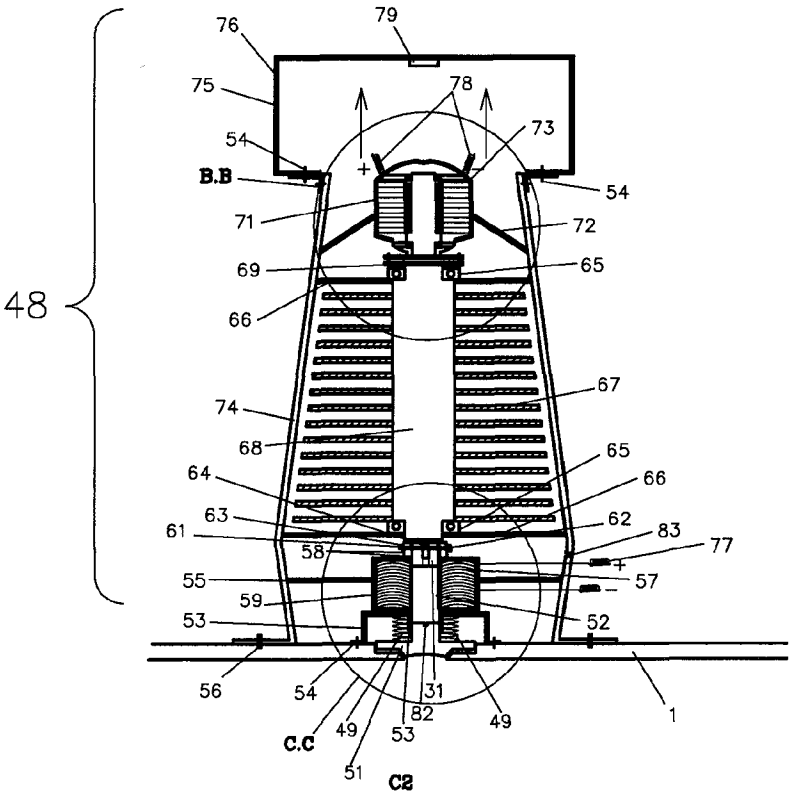
Fig 8B
Smoke Valve
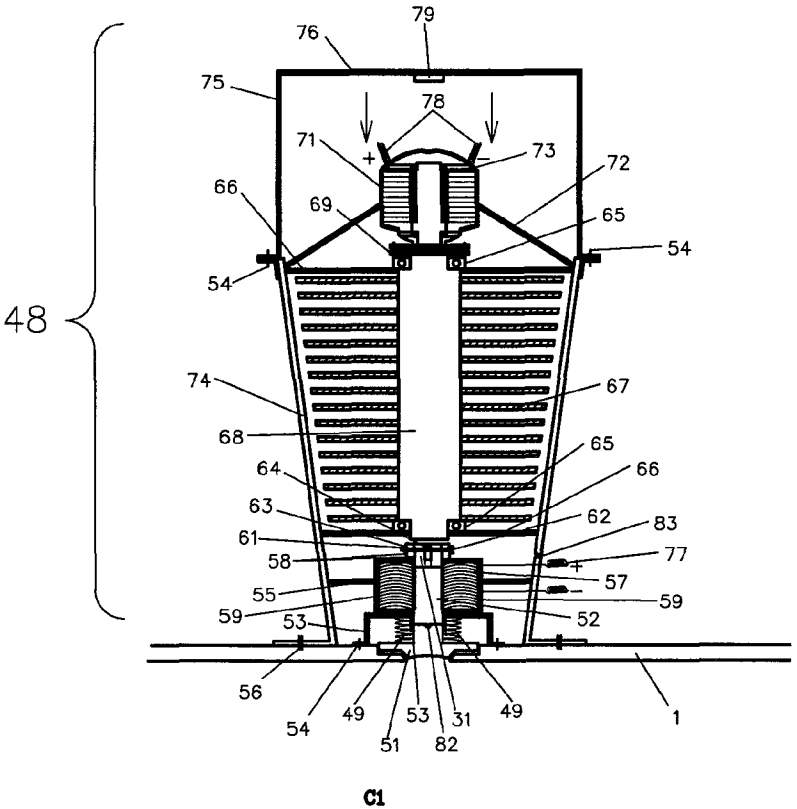
Fig 8A
Aire Valve
Fig 8

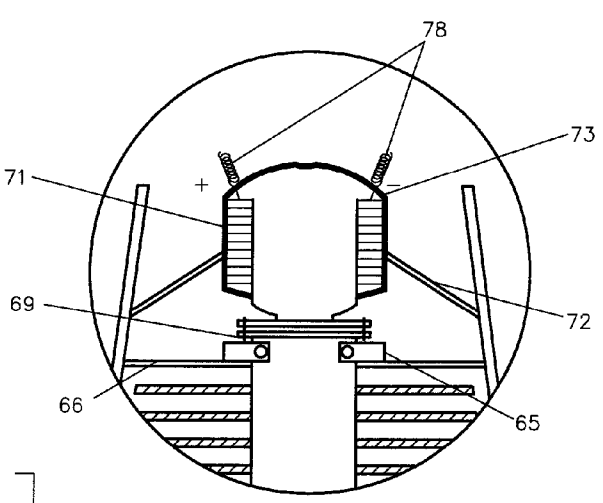
Detail B.B
Fig 9B
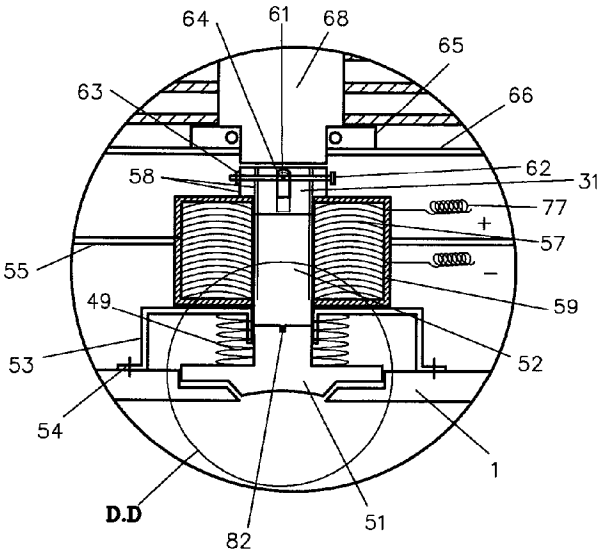
Detail C.C
Fig 9A
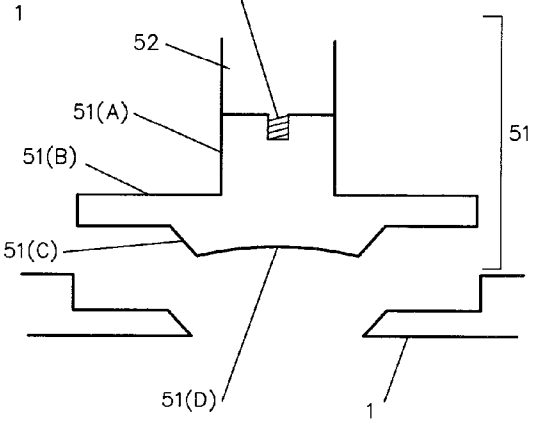
Detail D.D
Fig 9C
Fig 9

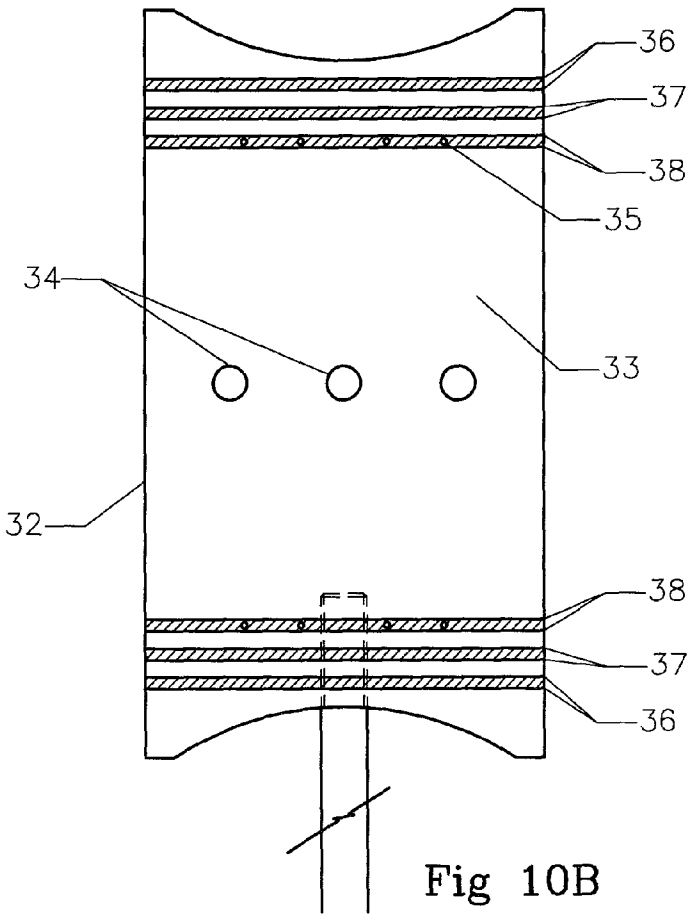
Fig 10B
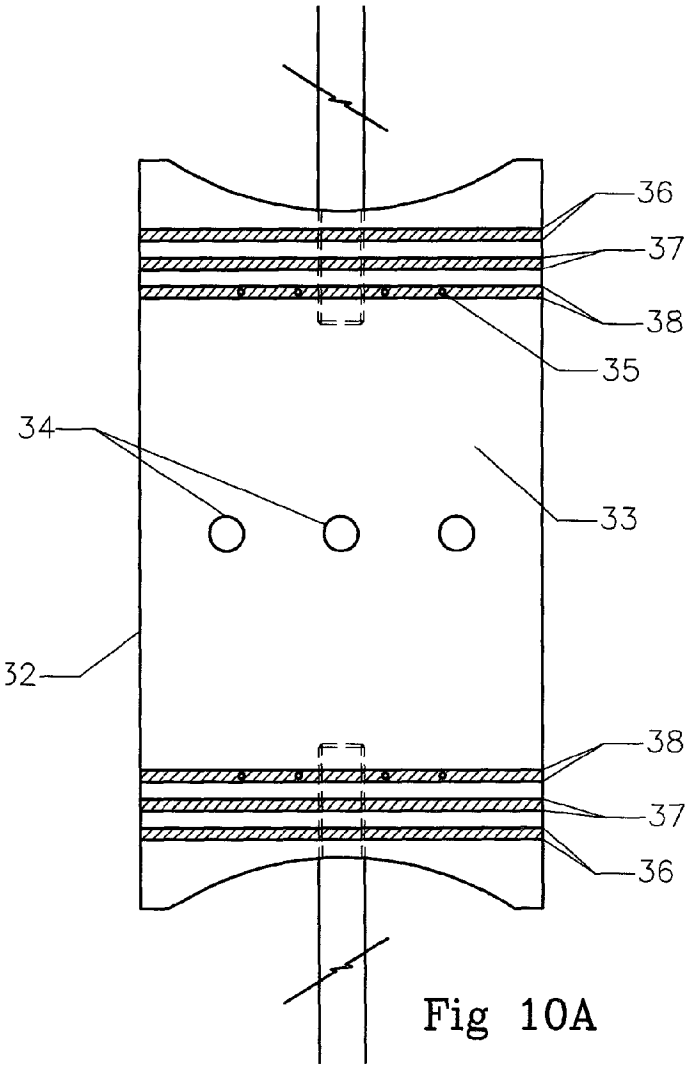
Fig 10A
Fig 10

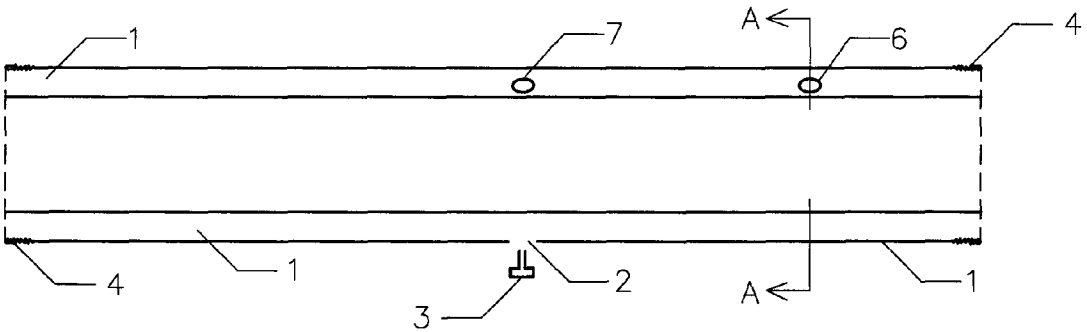
Fig 11A
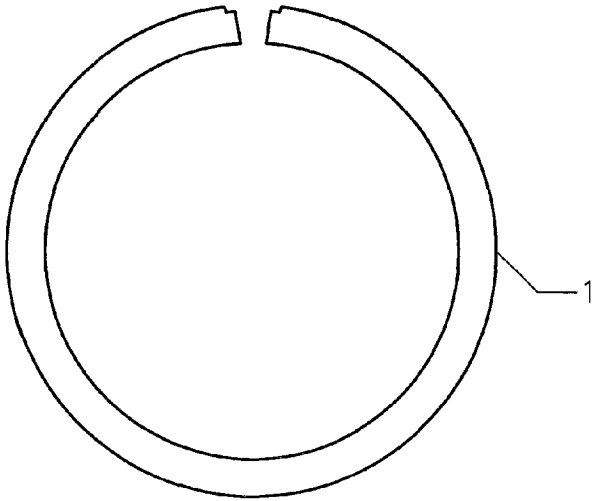
A–A
Fig 11B
Fig 11

8(1)

First Door

8(2)
Second Door

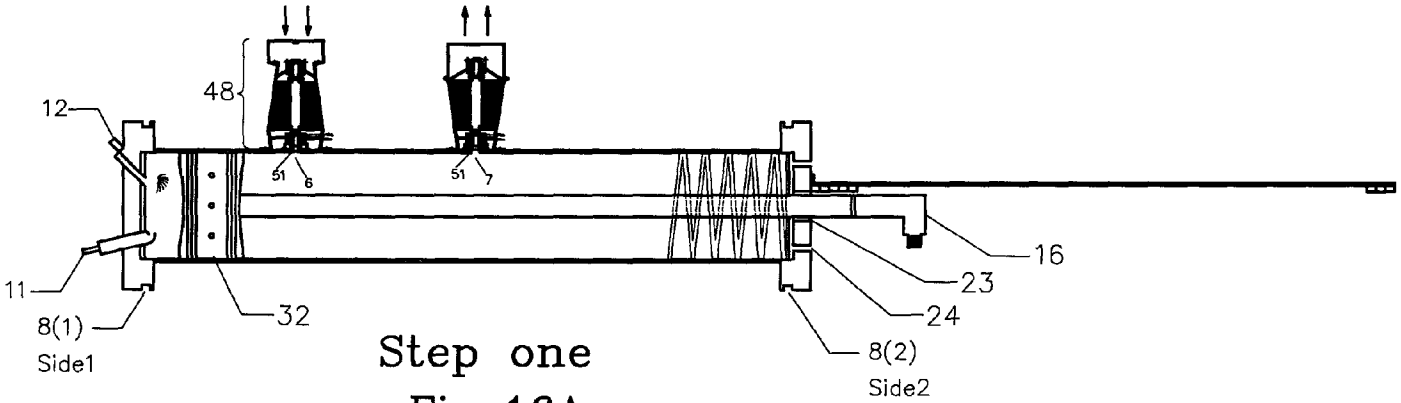
Step one
Fig 16A
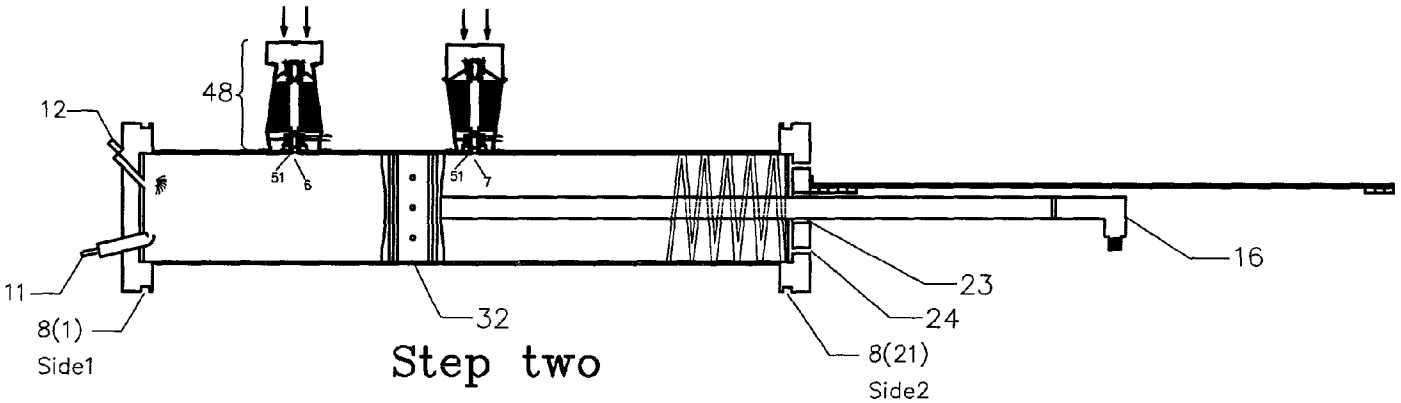
Step two
Fig 16B
Fig 16

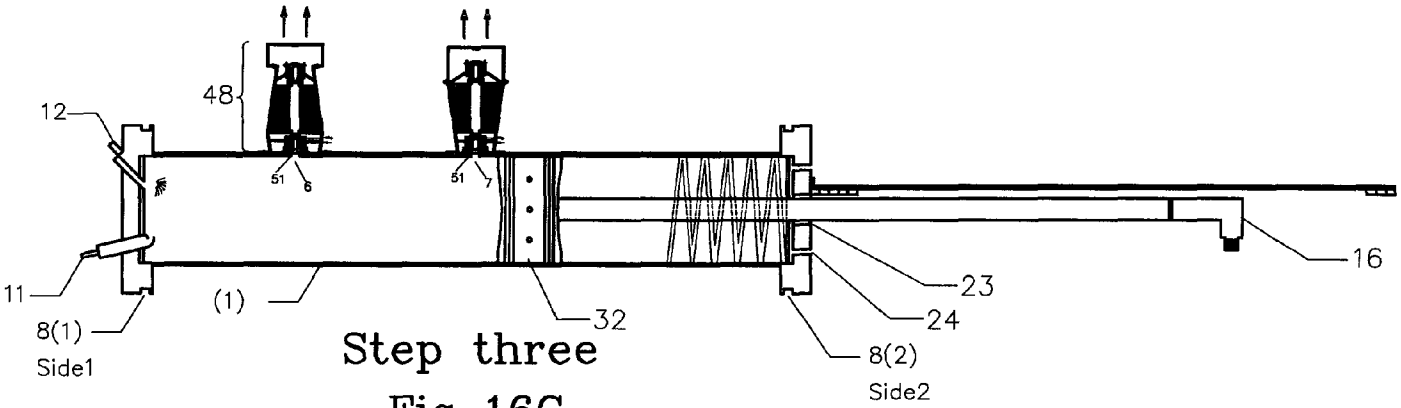
Step three
Fig 16C
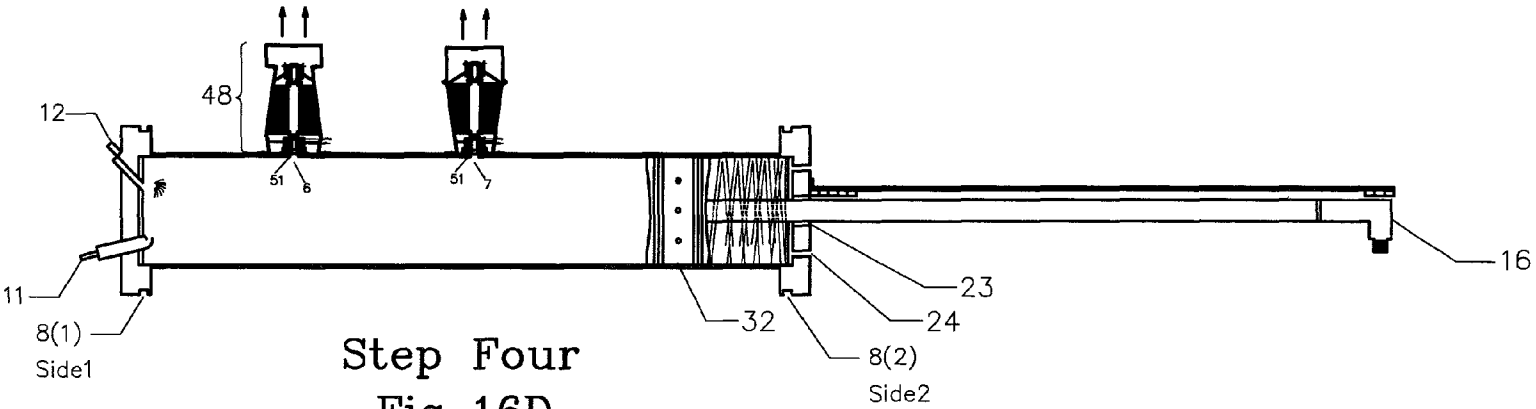
Step Four
Fig 16D
Fig 16

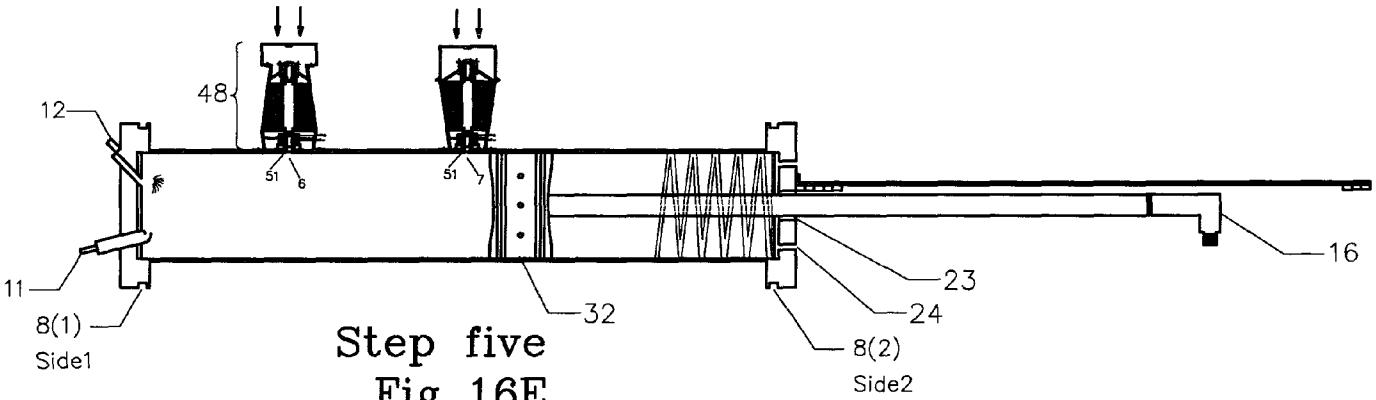
Step five
Fig 16E
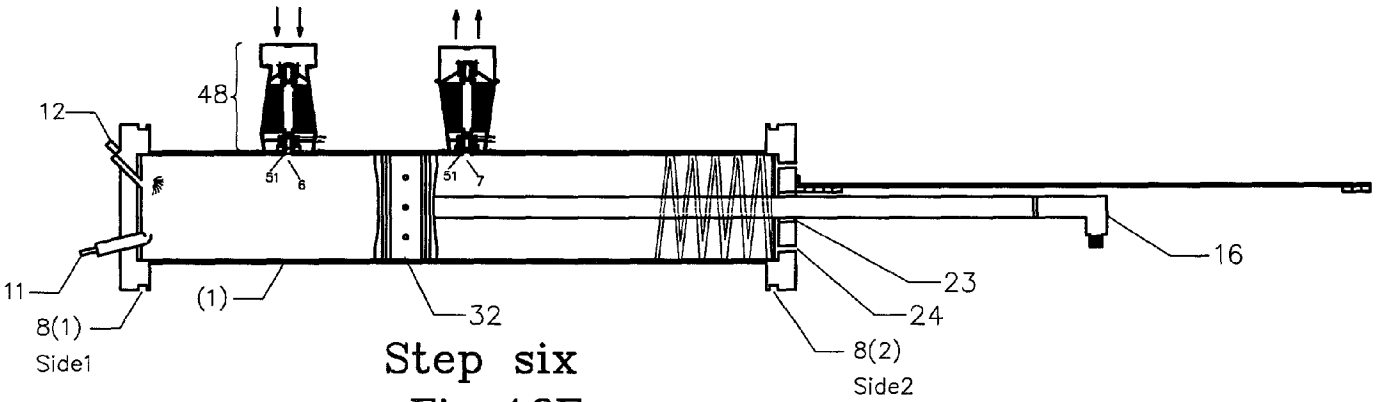
Step six
Fig 16F
Fig 16

SLIDING ENGINE WITH SHAFT ON ONE OR BOTH ENDS FOR DOUBLE OR SINGLE ENDED COMBUSTION

CROSS-REFERENCE TO RELATED PATENT APPLICATIONS

Embodiments of the present invention relate to U.S. Provisional Application Ser. No. 61/991,378, filed May 9, 2014, entitled "SLIDING SLEEVE ENGINE", the contents of which are incorporated by reference herein and which is a basis for a claim of priority.

BACKGROUND OF THE INVENTION

Field of the Invention

In this engine a mechanical system with electric valve (DC) has been used.

SUMMARY OF THE INVENTION

The present invention comprises of two embodiments of an improved sliding sleeve engine wherein a first embodiment includes a double ended combustion sliding sleeve engine, and the second embodiment includes a single ended combustion sliding sleeve engine.

In the first embodied double ended combustion engine the improved engine has several parts including one cylinder (1), with two doors ($\mathbf{8}_{(1)}$ and $\mathbf{8}_{(2)}$), installed on each side of the cylinder (1) (in the embodiment with two doors $\mathbf{8}_{(1)}$ and $\mathbf{8}_{(2)}$), a reciprocating piston (32) and three rings (36, 37 and 38), which are installed on two sides of the piston and three DC electric jet valves (48). Additionally a shaft (16) is installed on the piston section, with a magnetized ring (42) fitted on each shaft (16). On one of the doors a base (15) is installed and several sensors (17) sensitive to the magnetized ring (42) are fitted as a control circuit so that when the shaft and magnetic ring pass from opposite side of the sensors, the sensors (17) give necessary commands for timely performance of the sparkplugs (11), injector (12) and jet valves (48). Additional embodiments function so that when turning the key to start an engine the electric current of the battery flows into the control circuit (17) and starts the piston (32) and the shaft (16) connected to it. In the next step the injector sprays the fuel into the cylinder (1) and the sparkplug ignites the fuel and combustion takes place, pushing the piston from one side to the second side of the cylinder (1). The same process takes place in the second side of the cylinder reciprocally. Thus, two combustion happen in this engine as compared to the single combustion engines of the prior art. Additionally the shafts movement can be used for three purposes: 1—horizontally; 2—fully rotatory; and 3—semicircular reciprocating.

In the second embodied single ended combustion the improved engine has several parts including one cylinder (1), with a door {8 (1) and 8 (2)} installed on each side of the cylinder, a reciprocating piston (32) and the rings (36-37-38) which are installed on two sides of the piston and two electric jet valves (48) (DC). Furthermore, a shaft (16) is installed on the piston section, with delicate ring made from magnet (42) fitted on each shaft. Please note that on one of the doors, a base (15) is installed and several sensors (17) sensitive to magnet are fitted as control circuit, so that when the shaft and magnetic ring pass from opposite side of the sensors, the sensors (17) give necessary commands for timely performance of the sparkplugs (11), injector (12) and jet valves (48). In this system, by turning the key, the electric current of the battery flows into the control circuit (17) and by starting, the piston (32) and the shaft (16) connected to it will start functioning. In the next step, the injector sprays the fuel into the cylinder (1) and the sparkplug ignites and combustion takes place, pushing the piston from one side to the second side of cylinder and when the piston (32) reaches side 2 of the cylinder (1) and as a result of the contact between the piston and the spring, the piston is again pushed to side 1 (the starting point). Therefore, one combustions happen in this engine. It is worth mentioning that the shaft's movement can be used for three purposes: 1—horizontally, 2—fully rotatory, 3—semicircular reciprocating.

An embodied internal combustion engine comprises of the following components:

This engine includes a cylindrical cylinder, on either side of which a cylinder head is emplaced and a reciprocating (special) piston and the oil reserve tank is also located in the piston for lubricating the cylinder and it has two series of fire, compression and oil rings, located on the two sides of piston so that it can seal the cylinder housing. In addition, while lubricating the piston, the rings will prevent oil to flow into the combustion chamber and a fuel injection system (injector) for injecting fuel into the combustion chamber and a sparkplug for ignition which will lead to combustion of fuel and one or two shafts located on one or two sides of piston and with reciprocating motion of the piston, they exit from the center of engine cylinder head and will create the driving power in one or two gearboxes and a command control system for controlling the timely opening and closing of air and smoke valves, sparkplugs and injectors.

The special valve of this engine will provide more compaction, discharge and better breath in comparison with the common engines; in other words air is compressed into the cylinder and smoke exits from the cylinder speedily. For the same reason, it has a significant impact on fuel saving. In addition, smoke and air filters are emplaced on the valves which will produce less emissions compared with the similar engines. In comparison with similar engines in double-ended combustion engines, the fuel consumed in this engine is one-half (50%) whereas in the single-combustion embodiment the fuel consumed is decreased by one quarter.

In the embodied double sided combustion engine:

1—In this engine, with the first combustion, its piston and shaft will also move, and in the first linear motion of the shaft, the main gear rotates the gearbox for 180 degrees and with the second combustion and in the back motion of the shaft, the main gear rotates the gearbox for 180 degrees again, resulting in a 360 degree rotation.

Here, it is noteworthy that with the two combustions occurring in this engine, the gear of the engine's gearbox will rotate 360 degrees while in the ordinary engines, hypothetically the four cylinders with the four combustions will cause the engine crank to rotate 360 degrees, so in the embodied engine, the consumption of fuel is decreased by 50%.

2—In the embodied engine with two combustions with the installation of one head of the shaft and from the reciprocating motion of the shaft which will cause the gearbox to rotate 360 degrees, we can use for a driving power and with the installation of the two heads of the shaft we can use for two driving powers.

3—This engine does not have a crank inside the engine.

4—This engine does only have a reciprocating piston.

This engine consists of two main parts: cylinder and piston,

5—The oil reserve system has been designed within the piston for lubricating,

6—The fuel consumed in the sliding engine (double-ended combustion) is one-second of four stroke engines, taking into consideration the equal volume of cylinder in them.

7—Upon comparing the designed engine with the common engines with equal volume of cylinder, the current engine generates more power.

8—The special valve of this engine will cause more compaction, discharge and better breath in comparison with the common engines, thus resulting in more saving of fuel. Moreover, the air is compressed into the cylinder and smoke exits from the cylinder more speedily. In addition, the smoke and air filter are emplaced on the valve.

9—The current engine is designed so that it will eliminate a large number of engine parts, including crank, journal and driven bearing, connecting rod, engine belt, etc.

BRIEF DESCRIPTION OF THE DRAWINGS

FIG. 1 consists of FIGS. 1A and 1B wherein FIG. 1A shows a length-wise view of the detailed diagram of the cylinder according to an exemplary embodiment of the present invention. FIG. 1B represents a detailed cross-section view of the cylinder of FIG. 1A.

FIG. 6 consists of FIGS. 6A-6D which represent a detailed diagram of the method of timing of opening and closing of valves according to an exemplary embodiment of the present invention, wherein FIG. 6A demonstrates step one; FIG. 6B demonstrates step two; FIG. 6C demonstrates step three; and FIG. 6D demonstrates step four.

FIG. 8 consists of FIG. 8A air valve and FIG. 8B smoke valve which each demonstrate a detailed diagram of the valve parts according to an exemplary embodiment of the present invention.

FIG. 9 consists of FIGS. 9A, 9B and 9C which each demonstrate a detailed diagram of the valve parts and the location of air and smoke holes in the cylinder wall according to an exemplary embodiment of the present invention. Specifically FIG. 9A shows the valves (71) on the cylinder wall (1), magnet (57), Cam regulating screw (62), cam (64), Valve bearings (65) installation location; FIG. 9B shows the jet valve's engine (71) (DC); and FIG. 9C shows the detail of valve (51), cylinder wall (1) and the location of the air (7) and smoke (6) valve hole.

FIG. 10 consists of FIG. 10A and FIG. 10B which each provide a detailed diagram of the piston according to an exemplary embodiment of the present invention. Specifically FIG. 10A shows the figure of the valve and location of the fire (36), compression (37) and oil (38) rings with the installation of the shaft on both ends; and FIG. 10B shows the figure of the valve and location of the fire (36), compression (37) and oil (38) rings with the installation of the shaft on one of the two ends.

FIG. 11 consists of FIGS. 11A and 11B wherein FIG. 11A shows a length-wise view of the detailed diagram of the cylinder according to an exemplary embodiment of the present invention. FIG. 11B represents a detailed cross-section view of the cylinder of FIG. 11A.

FIG. 16 consists of FIGS. 16A-16F which represent a detailed diagram of the method of timing of opening and closing of valves according to an exemplary embodiment of the present invention, wherein FIG. 16A demonstrates step one; FIG. 16B demonstrates step two; FIG. 16C demonstrates step three; FIG. 16D demonstrates step four; FIG. 16E demonstrates step five; and FIG. 16F demonstrates step six.

DETAILED DESCRIPTION OF THE PREFERRED EMBODIMENT(S)

Figure 2:
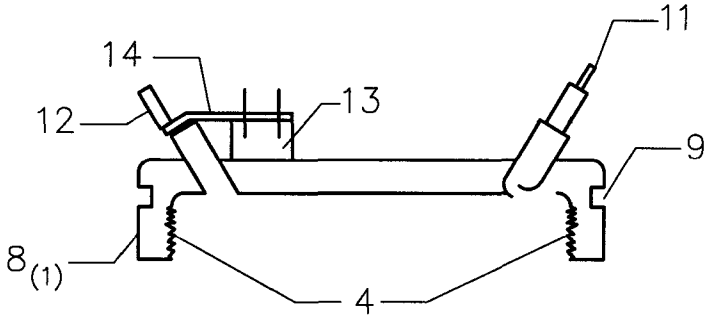
FIG. 2 is a detailed diagram of the first door according to an exemplary embodiment of the present invention.

Embodiments of the present improved engine are due to the punctual functioning of the injectors, sparkplugs and opening and closing of smoke and air valves, as a result of precise calculation of the distance between the sensors on command circuit base and magnetic rings on the shaft, that the sensors gives necessary instructions to the electronic system and the electronic system gives timely instructions to the injectors, sparkplugs and valves.

Exemplary Embodiment 1—Double Sided Combustion

The embodied engine has two command circuit systems, the first system receives some instructions on the shaft forward move at the instant that the shaft and magnetic ring from the control circuit sensors and the second system receives the instructions on the shaft return move at the instant that the shaft and magnetic ring from the control circuit sensors, and they timely transfer these instructions to other sections including injector, sparkplug and jet valves (for timely opening and closing of the smoke and air valves).

Details of the present invention will now be discussed by reference to the drawings.

Referring to FIG. 1 the cylinder (1) is cylindrical in shape, and is made of an alloy material resistant against tension and heat. A length-wise view of the cylinder (1) is shown in FIG. 1A and a cross-section at point A-A is shown in FIG. 1B. The volume, diameter, thickness, and length of the cylinder are calculated based on its usage. Also, a hole (2), has been created under the cylinder, and directly across the air hole (7) for the purpose of draining the piston tank (33) (shown in FIG. 4) oil. This hole is plugged and unplugged using a bolt (3). The location for three holes (in series) on the cylinder wall (1), in the shape of a round and a conic, has been designed and made, where, two are for smoke (6), and the other for air (7). On both ends of the cylinder a thread (4) has been made on the cylinder door for sealing.

Figure 3:
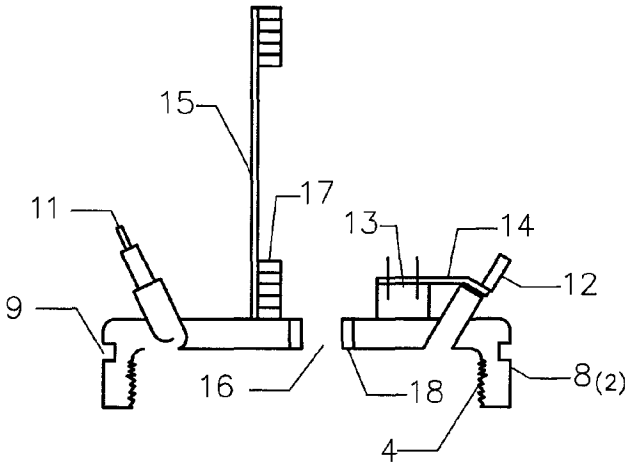
FIG. 3 is a detailed diagram of the second door according to an exemplary embodiment of the present invention.

Referring to FIGS. 2 and 3, the Cylinder doors ($\mathbf{8}_{(1)}$) shown in FIG. 2 as the first door and ($\mathbf{8}_{(2)}$) shown in FIG. 3 as the second door: are of the same material as the cylinder, and are installed on both sides of the cylinder. They include a piece which is closed and sealed using a thread (4) which has been created on the cylinder and its door. In addition, on the side of the cylinder door, holes have been created for firming (wrench shape 9). The cylinder doors are divided into two groups.

Referring to FIG. 2, the first door ($\mathbf{8}_{(1)}$) on which spark plug (11), injector base (13), injector (12), and injector plug (14) are installed. It should be noted that the injector is placed on the door at an angle of approximately 30° for better spraying of fuel.

Referring to FIG. 3, the second door ($\mathbf{8}_{(2)}$) on which spark plug (11), injector (12), injector base (13), Injector plug (14), and command circuitry base (15) is installed and its center of door a hole has been made for entry and exit of the shaft (16) which is sealed using seal (18), In addition in this diagram sensors (17) are installed on command circuitry base (15).

Further referring to FIGS. 2 and 3 the injector base (13) is a base which has been installed on the cylinder door, and the plug (14) which has been installed on this base is such that it makes the injector (12) sealed against the cylinder doors ($\mathbf{8}_{(1)}$ and $\mathbf{8}_{(2)}$).

Again referring to FIGS. 2 and 3 the injector (12) is installed on the cylinder doors ($\mathbf{8}_{(1)}$ and $\mathbf{8}_{(2)}$) and sprays the fuel inside the cylinder (1). In addition, the negative electric pole for the injector is drawn from the body, and the positive, after passing through the sensor (17), enters the injector (12).

As shown in FIGS. 2 and 3 the spark plug (11) works following the spraying of fuel the spark plug creates a spark, and combustion takes place.

FIG. 3 shows the command circuit basis (15) a basis is fitted up on the second door ($\mathbf{8}_{(2)}$), on which a number of sensors (17) have been positioned.

FIG. 10 shows the Rings which includes two series of fire, compression and oil rings, located on the two sides of piston so that it can seal the cylinder housing. In addition, while lubricating the piston, the rings will prevent oil to flow into the combustion chamber.

FIG. 10 additionally shows the Piston (32) which is inside the cylinder, and is of the material of an alloy resistant against expansion and contraction. The piston (32) is designed as double-ended and in one piece such that its internal chamber may be used as oil tank (33) for lubrication of the rings and cylinder. It contains fire (36), compression (37), and oil (38) rings. In addition, the diameter of the piston has been designed such that it may seal the cylinder chamber using the rings that are placed on it. It should be noted that the rings are installed on both sides of the piston. In addition, holes (34) have been made on the pistons (between the two oil rings) for injection and drainage of oil. Holes (35) have been created, for the lubrication of the cylinder and rings, on the piston and under the oil rings.

Figure 4:
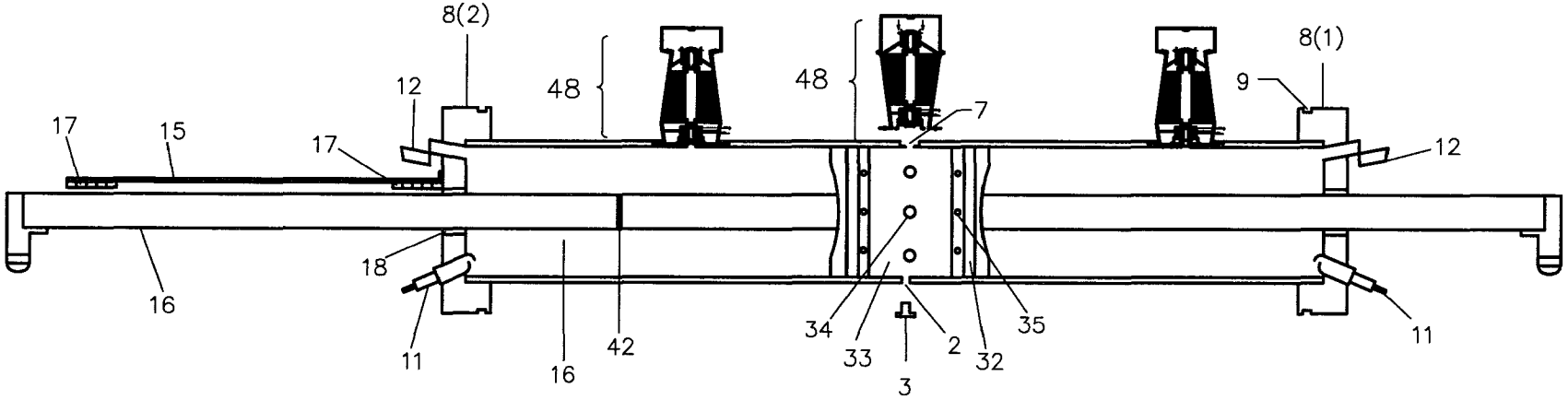
FIG. 4 is a detailed diagram of the piston with a shaft on both ends according to an exemplary embodiment of the present invention.

FIG. 4 shows the changing of the piston oil wherein first, the piston (32) is guided to the middle of the cylinder (facing the air valve), and, next, the screw hole under the cylinder (3) is removed so that the oil inside the piston (33) is drained through the piston holes (34, 35) and a hole under the cylinder (2). Next put the screw hole under the cylinder (3) back on, and after opening of jet valve through the air hole (7), using a special funnel, add the new oil to the piston (33).

Figure 7:
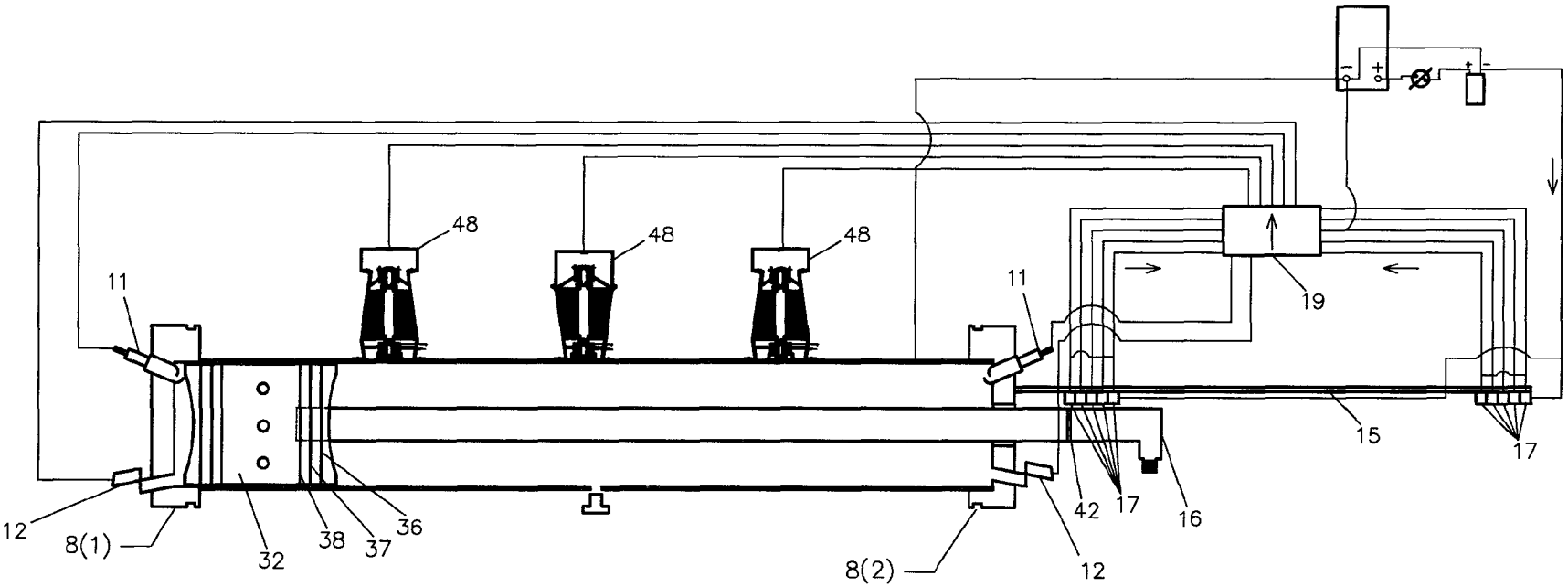
FIG. 7 is a detailed diagram of the command circuit and shaft and connection of shaft to piston according to an exemplary embodiment of the present invention.

FIG. 7 shows the Shaft (16) wherein the shaft has been attached to the section of the side 2 of the piston (32) and exited the center of second door ($\mathbf{8}_{(2)}$) of the cylinder. In addition, on the shaft, delicate ring (42) of magnet have been installed so that, at the instant that the shaft and magnetic ring passes by the sensors (17) (sensitive towards magnets), the sensors send the necessary commands to the electronic system, and the electronic system (19), in turn, transfer these commands to the other parts (including the jet valves (48), injectors (12), and spark plugs (11)).

FIG. 7 shows the Command circuitry which includes a number of sensors (17), installed on the command circuit base (15) and when the shaft (16) and magnetic ring (42) pass from opposite of the magnet sensitive sensors (17), the sensors give necessary command to the electronic system (19) and the electronic system transfers the data to other sections including injector (12), sparkplug (11), and jet valves (48) (for opening and closing of smoke 6 and air 7 valve).

FIG. 6 shows the Method of timing of opening and closing of jet valves (48) wherein the piston (32) is inside the cylinder (1) at the start position (side 1). At this time (i.e. starting time), the jet valve (48) related to smoke hole (6) of side 1 is closed, and, the jet valve (48) related to air hole (7) and the jet valve (48) related to smoke hole (6) of side 2 are open. At the instant that combustion takes place by the injector (12), spark plug (11), and compression of air, the piston (32) is pushed to side 2 of the cylinder (1). In its path, first crosses the smoke valve (6) of side 1, which is closed and as soon as the piston (32) reaches the air jet valve (7), the valve (51) related to air hole (7) and valve (51) related to smoke hole (6) of side 2 closes, and with the passing of the piston by the air jet valve (7), the valve (51) related to air hole (7) and valve (51) related to smoke hole (6) of side 1 reopens (but the smoke valve of side 2 remains closed) and When the piston (32) reaches side 2 of the cylinder (1), these actions (combustion) are repeated, and the piston returns to side 1. As explained in the description of the command circuitry (17), the necessary commands for opening and closing of valves (51) (opening and closing of jet valves 48) take place through the command circuitry (17).

FIGS. 8 and 9 show the Jet valve (48) which includes parts that altogether make the opening and closing of smoke and air holes possible and the elements of this jet valves (48), which have been installed on the holes of the cylinder wall (air 7 and smoke 6) include:

1—Valve (51): Valves are made from iron and as shown in detailed view D.D shown in FIG. 9C the valves are designed so that the upper part is quadrangle 51(A), and the edge of the valve is circled 51(B) and the bottom of the edge of the valve is conical 51(C) and bottom of the valves, as concave 51(D), and in harmony with the angle of the internal curvature of the cylinder to ensure that it is fit into the cylinder wall hole (1) In the section it has become circled and conical, and makes a vertical to-and fro motion, where the conic has been created on the cylinder wall hole (32), such that, with every to-and-fro movement, it is able to open and close the smoke (6) and air (7) hole.

2—Attached to the upper part of the valve (52): It is a cylindrical part, and connected to the upper part of the valve (the four-angled section 51A), by a screw (82). Please note that this part is added to the end part of the valve, in order to provide the possibility for adjustment by the cam (64). Moreover, the height of the valve tail is so that it does not impede the valve to open.

3—Quadrangular coil around upper valve (53): for preventing the valve from turning (considering the concavity of the bottom of the valves.

4—Quadrangular coil Screw around the valve upper (54): that connects the coil to cylinder.

5—Valve spring (49): its role and function is to return the valve to its initial (closed) state.

6—Valve magnet (57): for pulling the ferrous part (51) valve toward the interior of the magnet (57) (since the magnet develops magnetic property upon the induction of electric current to the magnet coil), and finally, opening the cylinder door by the valve.

7—Valve magnet base (55): A base is connected to two sides of the chassis of valve, on which magnet is located.

8—Valve magnet cover heat insulator (59): which is installed on the magnet cover in order to prevent transfer of heat to magnet coil;

9—Valve magnet bush (58): which is fitted within the magnet and the external edge of the bush, coming out of the magnet, is thicker than the internal bush.

10—Valve bearings (65): they are installed for fixing the rotating motion of shaft and the bearings are the lock-type and entail the shaft, which are installed above and below the shaft;

11—Bearings base (66): Two bases, one above the shaft and the other one below the shaft, are connected to two sides of the chassis and a bearing is installed on each one of them, and the shaft is located in the middle of these two bearings;

12—Valve shaft (68): Shaft is located between the top and lower bearings and while fixing the shaft, it prevents the linear movement of the shaft and are connected to engine rotor by coupling;

13—Jet valve vanes (67): These vanes are designed similar to jet compressor vanes and they are installed and connected to the shaft.

14—Valve chassis (74): contains a set of parts which are collectively referred to as valve, and are installed on top of the cylinder with two screws.

15—Valve chassis screw (56): which connects chassis to cylinder.

16—Jet valve engine (71) (DC): it is used for rotatory motion of the shaft and it is installed on the shaft.

17—Valve engine heat insulator (73): A thermal insulator is installed on the engine in order to prevent the increase of heat transmission to the engine coil.

18—Engine base (72): On which the engine is installed and connected to two sides of the jet valve chassis.

19—Shaft coupling to the engine rotor (69): Coupling connects shaft to engine rotor.

20—Valve cover (75): installed on the jet valve chassis by two screws (81).

21—Air valve cover filter (76): A filter installed on the jet valve chassis cover in order to prevent the entrance of dust.

22—Smoke valve cover filter (76): A filter is placed on the cover of the valve in order to purify the smoke coming out from the engine.

23—Thermistor (79): Installed on the valve cover in order to diagnose the degree of temperature of the valve case.

24—Cam regulating screw (62): the regulating screw passes through the external bush of magnet.

25—Cam (64): which is installed on the regulating screw (61) by a fix bolt in order to adjust the valve.

26—Cam Adjustment Screw Fixing Nut (63): that fixes the adjusting screw,

27—Engine Positive-Negative Poles Electric Wire (DC) (78)

28—Wire connected to positive pole of the magnet (77): enters into the magnet via sensor. Additionally, as embodied the negative current enters into the magnet via body.

29—Valve clearance adjusting orifice (83): An orifice is made on the jet valve frame in order to adjust the valve clearances.

All parts of jet valve including the engine stands, bearings and magnet are connected with a screw to the jet valve frame and by opening the screw and jet valve frame, we can have access to all parts of the jet valve.

FIG. 4 shows an embodied engine wherein the engine includes three jet valves (48).

FIGS. 8 and 9 detail the Valves magnet (57) wherein in the center of the magnet a hole (31) has been made for the purpose of attracting the ferrous part (51) which, immediately following the sending of command for electric to the magnet (since with the electric current to the magnet coil the magnet develops magnetic property) the ferrous piece (valve 51) is pulled toward the interior of the magnet, and following the rise of the valve (51), the cylinder wall hole (1) (related to smoke (6) and air (7) valve) is opened. It should be noted that, as soon as the command for electric current stops, a spring (49) enters into action in order to return the valve (51) to its initial position (closing of the cylinder wall hole 1) related to smoke (6) and air (7) valve. This spring (49) is placed around the ferrous piece (51), between the top of the valve (51) and below of quadrangular coil around upper valve (53). The bottom of the valve (because of the cylindrical shape of cylinder), is concaved 51(D), and shaped to match the angle of the intrados of the cylinder (1), and in order to prevent the turning of the valve (51) and its collision with piston (32) inside the cylinder, the upper part of valves 51 (A) are shaped to be quadrangle, and a quadrilateral coil (53) has been wound around it; this coil is installed on the valve chassis (74) so that the valve is able to move directly (vertically) inside it and prevent the rotating of valve piston.

FIG. 6 shows the Jet valves (48) are divided into two groups: 1—Jet valve (48) related to smoke hole (6), which is placed near the two ends of the cylinder wall, 2—Jet valve (48) related to air hole (7) emplaced in the middle of the cylinder wall and between the two smoke holes.

Figure 5:
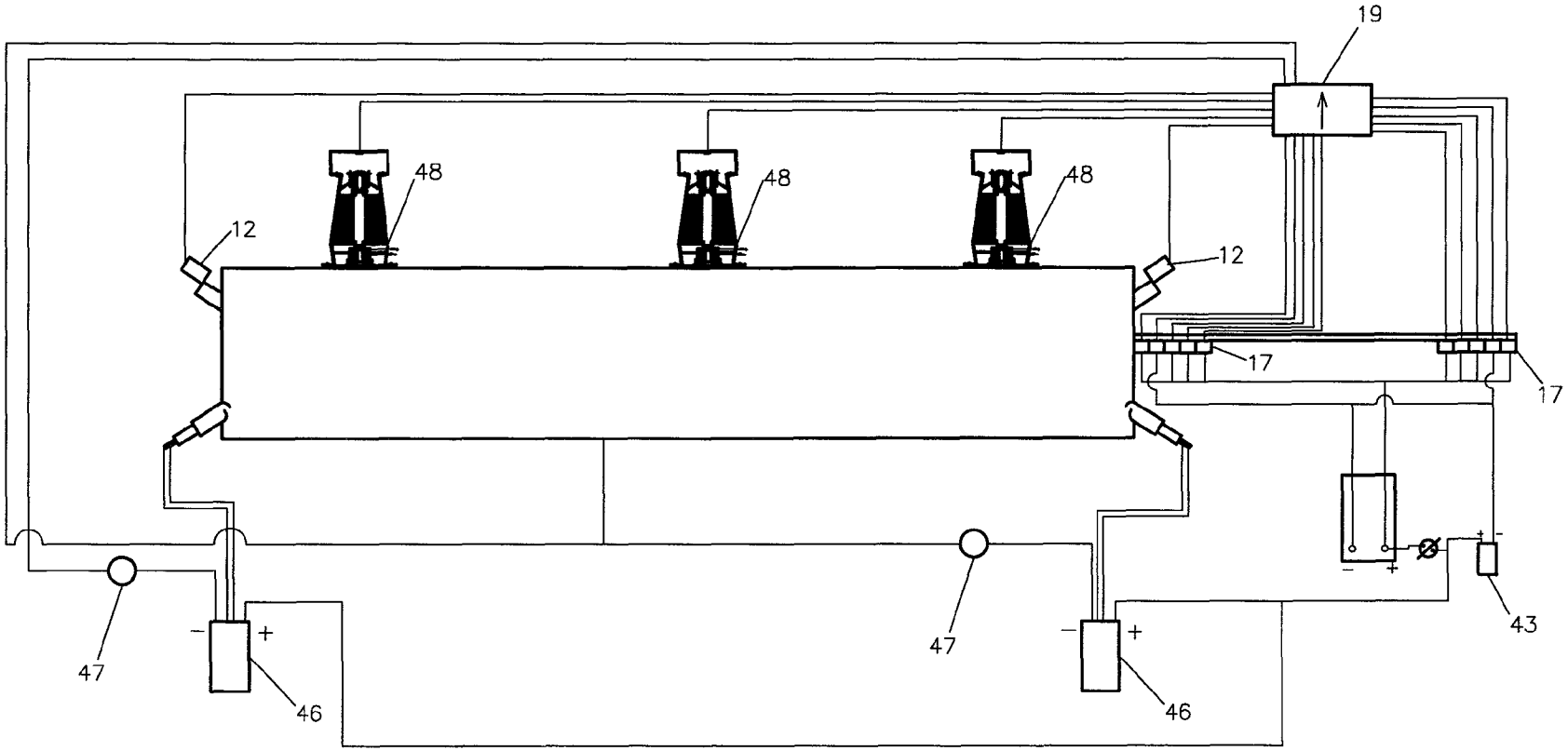
FIG. 5 is a detailed diagram of the power supply system and command circuit according to an exemplary embodiment of the present invention.

FIG. 5 shows the Power supply system (DC) wherein the positive terminal of the battery is first connected to the injector pump (43), positive pole of the coil (46) and the control circuit (sensors 17) and it is then taken into electronic system (19) and from the electronic system to the jet valves (48) and injector (12) through the control circuit. It is obvious that the negative current flows into them through the body (except the coil). Further, the negative current of the battery flows into the body and control circuit (sensors 17) and from control circuit to electronic system (19) and from there into the fuse (47) and from there to coil (46) and from there into the sparkplug (11).

FIG. 7 shows the Engine function wherein the engine has several parts including cylinder (1) and two doors ($\mathbf{8}_{(1)}$ and $\mathbf{8}_{(2)}$) and one reciprocating piston (32), and on one side of the piston section, a shaft (16) is positioned and delicate ring made from magnet (42) are fitted into this shaft and exit from the center of the second door $\mathbf{8}_{(2)}$ of cylinder. Moreover, a command circuit base (15) is positioned on the second door $\mathbf{8}_{(2)}$, and on this base, there some sensors (17) sensitive to magnet have been placed. By turning the key, the electricity of battery flows into the control circuit and by pushing the start button, the piston and the shaft connected to it shall also start functioning and upon passing of shaft and magnetic ring from the opposite side of the sensors (17), sensitive to the magnet, the sensors issue necessary commands to the electronic system (19) and the electronic system transfers the data to other sections including the injector (12), sparkplug (11) and jet valves (48), and by these commands, the injector sprays the fuel into the cylinder (1) and the sparkplug ignites and the combustion takes place, pushing the piston from the first side to the second side of cylinder. Further, the instructions given to the jet valves will make the timely opening and closing of smoke and air valves as shown in FIGS. 6A-6D wherein FIG. 6A represents step one; FIG. 6B represents step two; FIG. 6C represents step three; and FIG. 6D represents step four.

Embodiments of the present improved engine are due to the punctual functioning of the injectors, sparkplugs and opening and closing of smoke and air valves, as a result of precise calculation of the distance between the sensors on command circuit base and magnetic rings on the shaft, that the sensors gives necessary instructions to the electronic system and the electronic system gives timely instructions to the injectors, sparkplugs and valves.

The embodied engine has two command circuit systems, the first system receives some instructions on the shaft forward move at the instant that the shaft and magnetic ring from the control circuit sensors and the second system receives the instructions on the shaft return move at the instant that the shaft and magnetic ring from the control circuit sensors, and they timely transfer these instructions to other sections including injector, sparkplug and jet valves (for timely opening and closing of the smoke and air valves).

When starting the engine, the piston starts moving (to position it in the combustion point). It is obvious that after the engine gets started, the start is disconnected from the circuit.

According to FIG. 4 which shows an embodied engine with a shaft on both ends is used the steps are: 1—install the shaft on both sides of the piston base (without installing magnetic ring on the second shaft), 2—create a hole in the center of the first cylinder door for the passage of the shaft which has been sealed using a seal. In the present embodiment the two shafts can be used as two axles. In embodiments wherein both ends of the shaft have been used for the first door $\mathbf{8}_{(1)}$, the second door $\mathbf{8}_{(2)}$ is used without utilization of the base and command circuitry.

Exemplary Embodiment 2—Single-Sided Combustion

Referring to FIG. 11 the single-sided combustion engine has the same features as in described FIG. 1 above and the double ended combustion.

Figure 12:
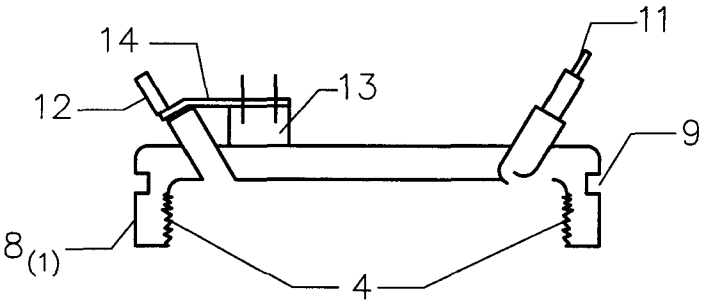
FIG. 12 is a detailed diagram of the first door according to an exemplary embodiment of the present invention.
Figure 13:
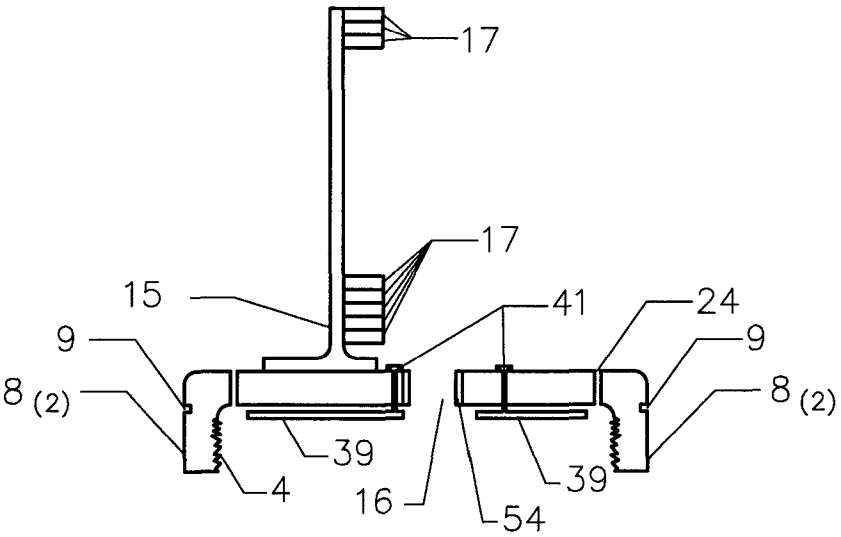
FIG. 13 is a detailed diagram of the second door according to an exemplary embodiment of the present invention.

The Cylinder doors referred to in FIGS. 12 and 13 are the same as those described in FIGS. 2 and 3 above in the double ended combustion embodiment.

(Referring to FIG. 12) A: first door 8 (1): (in the combustion section of the cylinder) exactly like double ended combustion described above in relation to FIG. 2.

(Referring to FIG. 13) B: Second door 8 (2): (in the knocking section) exactly like double ended combustion described above in relation to FIG. 3.

(Referring to FIG. 12) Injector base (13): a base which has been installed on the cylinder first door. (Exactly like double ended combustion above in relation to FIG. 2).

(Referring to FIG. 2) Injector (12): is installed on the cylinder first door. (Exactly like double ended combustion above in relation to FIG. 2).

(Referring to FIG.2) Spark plug (11): Exactly like double ended combustion above in relation to FIG. 2.

(Referring to FIG. 13) Command circuit basis (15): Exactly like double ended combustion above in relation to FIG. 3.

(Referring to FIG. 10) Piston (32): Exactly like double ended combustion.

(Referring to FIG. 10) Rings: Exactly like double ended combustion.

Figure 14:
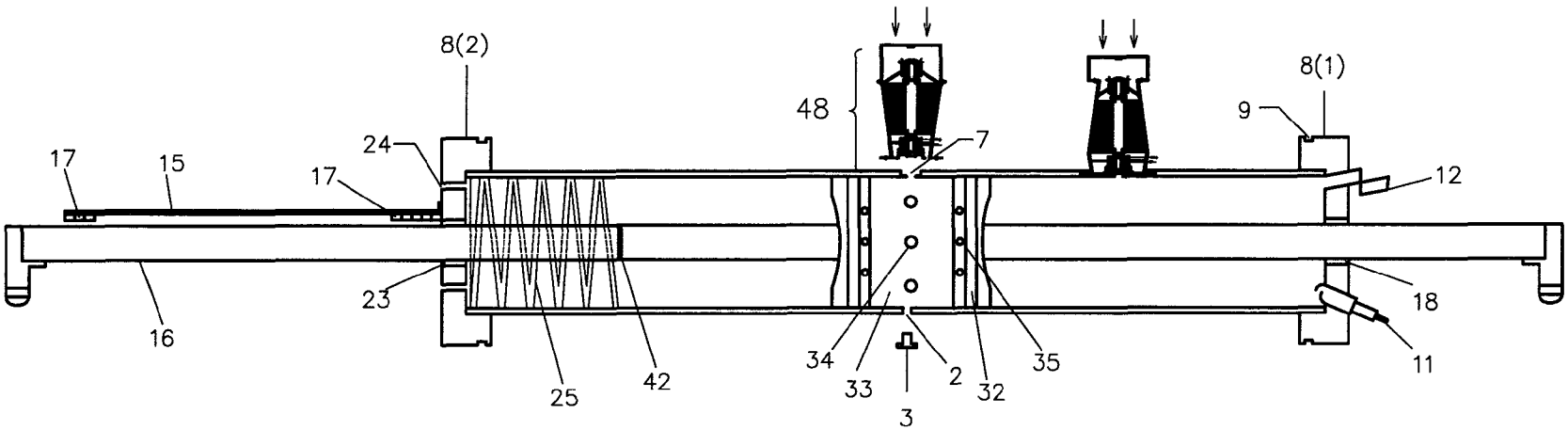
FIG. 14 is a detailed diagram of the piston with a shaft on both ends according to an exemplary embodiment of the present invention.

(Referring to FIG. 14) Changing the piston oil: Exactly like double ended combustion above in relation to FIG. 4.

Figure 17:
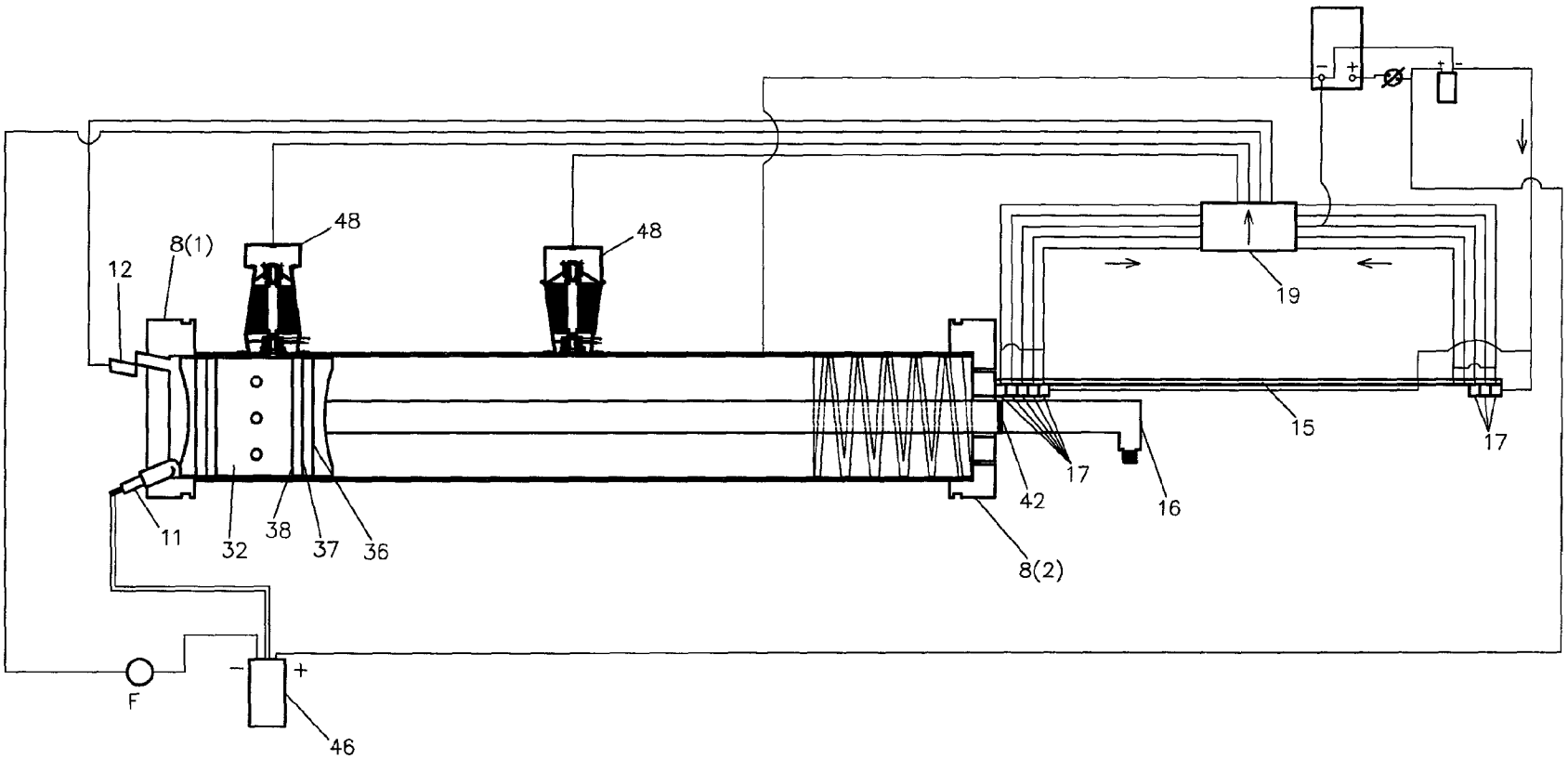
FIG. 17 is a detailed diagram of the command circuit and shaft and connection of shaft to piston according to an exemplary embodiment of the present invention.

(Referring to FIG. 17) Shaft (16): Exactly like double ended combustion above in relation to FIG. 7.

(Referring to FIG. 17) Command circuitry: Exactly like double ended combustion above in relation to FIG. 7.

(Referring to FIG. 16) Method of timing of opening and closing of jet valves (48): we consider the piston (32) inside the cylinder (1) at the start position (side 1). At this time (i.e. starting time), the jet valve (48) related to smoke hole (6) of side 1 is closed, and, the jet valve (48) related to air hole (7) is open. At the instant that combustion takes place by the injector (12), spark plug (11), and compression of air, the piston (32) is pushed to side 2 of the cylinder (1). In its path, first crosses the jet valve (48) related to smoke hole (6) of side 1, which is closed and as soon as the piston (32) reaches the air jet valve (7) the valve (51) related to air hole (7) closes and with the passing of the piston by the air jet valve (7), the valve (51) related to air hole (7) and smoke (6) opens in order to let out the smoke created by combustion inside the cylinder (1). When the piston (32) reaches side 2 of the cylinder and as a result of the contact between the piston and the spring, the piston is again pushed to side 1 (the starting point). In its return path, as soon as the piston reaches the air valve (7), the air (7) and smoke (6) jet valves both close. After the piston crosses the air jet valve, the air jet valve reopens, but the smoke jet valve remains closed. After the piston crosses the smoke valve, and reaches the initial point, combustion takes place again, and this action is repeated. As explained in the description of the command circuitry (17), the necessary commands for opening and closing of valves (51) (opening and closing of jet valves 48) take place through the command circuitry (17).

(Referring to FIGS. 8 and 9) Jet valve (48): Includes parts that altogether make the opening and closing of smoke and air holes possible and the elements of this jet valves (48), which have been installed on the holes of the cylinder wall (air 7 and smoke 6) include: Exactly like double ended combustion.

(Referring to FIG. 14) This system: includes two jet valves (48).

(Referring to FIGS. 8 and 9) Valve magnets (57): Exactly like double ended combustion.

(Referring to FIG. 16) Jet valves (48) are divided into two groups: 1—Jet valve (48) related to smoke hole (6), which is placed near the one ends of the cylinder wall, 2—Jet valve (48) related to air hole (7) emplaced in the middle of the cylinder wall.

Figure 15:
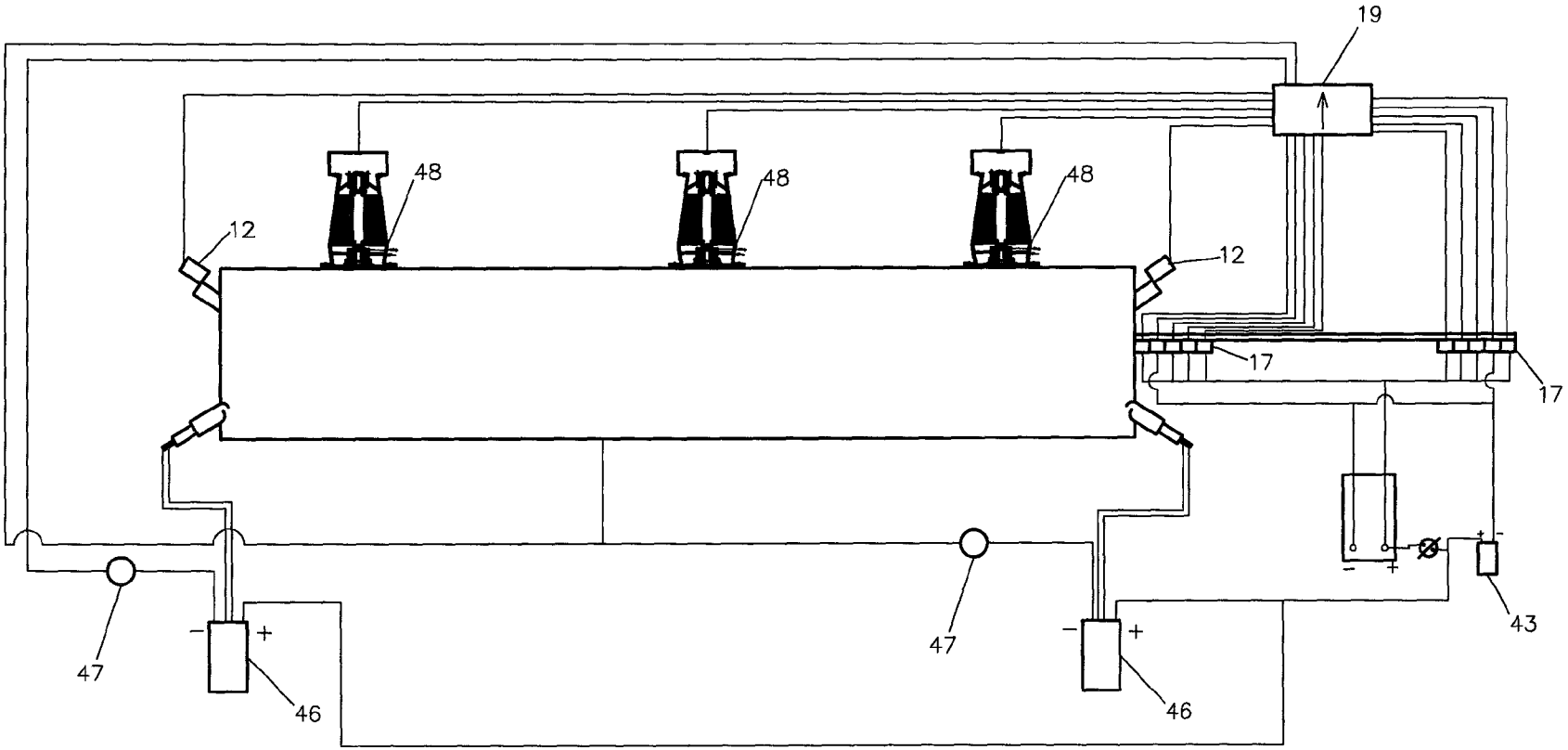
FIG. 15 is a detailed diagram of the power supply system and command circuit according to an exemplary embodiment of the present invention.

(Referring to FIG. 15) Power supply system (DC): Exactly like double ended combustion above in relation to FIG. 5.

(Referring to FIG. 17) Engine function: This engine has got several parts including cylinder and two doors {8(1) and 8(2)} and one reciprocating piston (32), and on one side of the piston section, a shaft (16) is positioned and delicate ring made from magnet (43) are fitted into this shaft and exit from the center of the second door of cylinder. Moreover, a command circuit base (15) is positioned on the second door 8(2), and on this base, there some sensors (17) sensitive to magnet have been placed. By turning the key, the electricity of battery flows into the control circuit and by pushing the start button, the piston and the shaft connected to it shall also start functioning and upon passing of shaft and magnetic ring from the opposite side of the sensors (17), sensitive to the magnet, the sensors issue necessary commands to the electronic system (19) and the electronic system transfers the data to other sections including the injector (12), sparkplug (11) and jet valves (48), and by these commands, the injector sprays the fuel into the cylinder (1) and the sparkplug ignites and the combustion takes place, pushing the piston from the first side to the second side of cylinder. Further, the instructions given to the jet valves will make the timely opening and closing of smoke and air valves.

Embodiments of the present improved engine are due to the punctual functioning of the injectors, sparkplugs and opening and closing of smoke and air valves; (Exactly like double ended combustion).

Please note that this engine has got two command circuit systems; (Exactly like double ended combustion.)

Please note that by starting, the piston starts moving (to position it in the combustion point). It is obvious that after the engine gets started, the start is disconnected from the circuit.

(Referring to FIG. 14) In case we choose to use this engine with a shaft on both ends we must 1—install the shaft on both sides of the piston base (without installing magnetic ring on the second shaft), 2—create a hole in the center of the first cylinder door for the passage of the shaft which has been sealed using a seal. Obviously, in this case the two shafts can be used as two axles. It should be noted that, in case both ends of the shaft have been used in the center of first door a hole has been made for entry and exit of the shaft (16) which is sealed using seal (18).

Exactly like double ended combustion but in comparison with similar engines in single-ended combustion engines, the fuel consumed in this engine is decreased 25%.

What is claimed is:

1. An internal combustion engine comprising:

a cylindrical cylinder, on either side of which a cylinder head is emplaced and a reciprocating piston;

wherein the engine further comprises two series of fire, compression and oil rings, located on the two sides of the piston which seal a cylinder housing;

wherein the piston has an internal chamber that is used as an oil tank for lubrication of the rings and cylindrical cylinder;

further wherein while lubricating the piston, the rings prevent oil to flow into a combustion chamber and a fuel injection system for injecting fuel into the combustion chamber and a sparkplug for ignition which lead to combustion of fuel; and at least one shafts located on one or two sides of the piston and with reciprocating motion of the piston, the shafts exit from the center of the engine cylinder head and create the driving power in two gearboxes and a command control system for controlling the timely opening and closing of air and smoke valves, sparkplugs and injectors; wherein the piston of the engine is reciprocating.

2. The engine of claim 1 further comprising three jet valves with plurality of vanes.

3. The engine of claim 1, further comprising a first smoke valve, a air valve and a second smoke valve in sequence between the first set of injector and sparkplug and the second set of injector and spark plug.

4. The engine of claim 1, wherein a first smoke valve is closed and the air valve and a second smoke valve are open when the piston is located between the first set of injector and sparkplug and the first smoke valve before a combustion takes place between them.

5. The engine of claim 1, wherein at the instant that combustion takes place, the piston crosses the smoke valve of on a first side, which is closed and as soon as the piston reaches the air valve, the air valve and the smoke valve of a second side that is opposite of the first side closes.

6. The engine of claim 5, wherein when the passing of the piston by the air valve takes place, the air valve and smoke valve of the first side reopens; while the smoke valve of the second side remains closed.

7. The engine of claim 6, wherein when the piston reaches the second side of the cylinder, these actions (combustion) are repeated, and the piston returns to the first side.

8. The engine of claim 1, wherein the engine does not have a crank inside the engine.

9. An internal combustion engine comprising:

a cylindrical cylinder, on either side of which a cylinder head is emplaced and a reciprocating piston;

wherein the engine further comprises two series of fire, compression and oil rings, located on the two sides of the piston which seal a cylinder housing;

wherein the piston has an internal chamber that is used as an oil tank for lubrication of the rings and cylindrical cylinder; and wherein while lubricating the piston, the rings are arranged in a way to prevent oil to flow into a combustion chamber and a fuel injection system for injecting fuel into the combustion chamber and a sparkplug for ignition which lead to combustion of fuel.

* * * * *